US006926806B2

(12) United States Patent
Honkalampi et al.

(10) Patent No.: US 6,926,806 B2
(45) Date of Patent: Aug. 9, 2005

(54) SIMPLE PRESS SECTION IN A PAPER OR BOARD MACHINE

(75) Inventors: Petter Honkalampi, Kinkomaa (FI); Petteri Halme, Jyväskylä (FI); Juhani Pajula, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 343 days.

(21) Appl. No.: 10/204,617

(22) PCT Filed: Feb. 1, 2001

(86) PCT No.: PCT/FI01/00094

§ 371 (c)(1),
(2), (4) Date: Oct. 22, 2002

(87) PCT Pub. No.: WO01/63042

PCT Pub. Date: Aug. 30, 2001

(65) Prior Publication Data

US 2003/0089480 A1 May 15, 2003

(30) Foreign Application Priority Data

Feb. 22, 2000 (FI) ..... 20000404

(51) Int. Cl.[7] ..... D21F 3/04

(52) U.S. Cl. ..... 162/360.2; 162/358.1; 162/358.3

(58) Field of Search ..... 162/204–207, 162/210, 358.1, 358.3, 358.5, 359.1, 360.2, 360.3, 361, 305, 306; 100/150–156, 37, 207, 116, 118, 121

(56) References Cited

U.S. PATENT DOCUMENTS 2,653,523 A * 9/1953 Hornbostel ..... 162/274
3,981,084 A * 9/1976 Sobota ..... 34/123
4,219,383 A * 8/1980 Valkama ..... 162/360.2
4,483,745 A * 11/1984 Wicks et al. ..... 162/205
4,556,451 A * 12/1985 Ely ..... 162/205
4,704,192 A * 11/1987 Cronin ..... 162/360.2
4,879,001 A * 11/1989 Cronin ..... 162/206
4,931,143 A * 6/1990 Karvinen et al. ..... 162/360.2
4,976,821 A * 12/1990 Laapotti ..... 162/360.2
4,988,410 A 1/1991 Meinecke et al.
5,256,257 A 10/1993 Schiel
5,522,959 A 6/1996 Ilmarinen
5,545,295 A 8/1996 Fujita et al.
6,261,416 B1 * 7/2001 Esslinger et al. ..... 162/205
6,527,916 B2 * 3/2003 Schiel ..... 162/360.2

FOREIGN PATENT DOCUMENTS

| | | |
|---|---|---|
| DE | 42 29 683 A1 | 4/1993 |
| FI | 920082 | 7/1992 |
| FI | 981110 | 8/1999 |
| WO | WO 99/60202 A1 | 11/1999 |
| WO | WO 01/63042 A1 | 8/2001 |

OTHER PUBLICATIONS

Search Report issued in Finnish Priority Application No. 20000404.
International Search Report Issued in PCT/FI01/00094.
International Preliminary Examination Report issued in PCT/FI01/00094.

* cited by examiner

*Primary Examiner*—Eric Hug
(74) *Attorney, Agent, or Firm*—Stiennon & Stiennon

(57) ABSTRACT

A web (W) passes through a press section having two separate press nips ($N_1$, $N_2$). At least the first press nip ($N_1$) has two water-receiving press felts (31, 41). After the first nip ($N_1$), the web (W) is separated from one press felt (31/41) and transferred on support of the opposite press felt (41/31) through the second press nip ($N_2$). One roll of the first nip ($N_1$) is a press suction roll (11, 110) and the web (W) is transferred to follow the press felt (31, 41) on the side of said press suction roll (11, 110) by means of an underpressure in a suction zone (11*a*, 110*a*) of said press suction roll (11, 110). The press felt (31, 41) on the side of the press suction roll (11, 110) is also passed through the second nip ($N_2$) of the press section.

7 Claims, 4 Drawing Sheets

SIMPLE PRESS SECTION IN A PAPER OR BOARD MACHINE

CROSS REFERENCES TO RELATED APPLICATIONS

This application is a U.S. national stage application of International Application No. PCT/FI01/00094, filed Feb. 1, 2001, and claims priority on Finnish Application No. 20000404 filed Feb. 22, 2000, the disclosures of these applications being hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a simple press section in a paper or board machine.

In this application, by a separate press nip is meant a press nip in which press members lying against each other form only one press nip. A separate press nip can be a roll nip or an extended nip. A contrast to a separate press nip is a press provided with a centre roll, in which press the centre roll forms a press nip with at least two other rolls.

The function of a press section is to remove water from a web and make the web symmetric, with the result that the absorption and roughness properties of both sides of the web are symmetric. Moreover, the press section should be simple and efficient enough in order that it might be applied to several paper grades. Furthermore, the construction and maintenance costs of the press section must not become too high.

At high speeds in particular, the run of the web in the press section should be as straight as possible. The aqueous and weak web arriving at the press section does not withstand the dynamic forces caused by high speeds and changes of direction, but there occur web breaks and other operational malfunctions which cause shutdowns.

In Metso Paper, Inc.'s WO laid-open publication 99/60202, FIG. 1 shows a press section provided with two separate extended nips. The extended nips are formed by an upper shoe roll and a lower press suction roll. Both nips are double-felted, in which connection dewatering takes place in both nips in two directions. The web travels in the first nip between a first upper press felt, which is a pick-up felt, and a first lower press felt, and in the second nip between a second upper press felt and a second lower press felt. Thus, four press felts are used in this arrangement.

In Metso Paper, Inc.'s U.S. Pat. No. 5,522,959, FIG. 1 shows a press section provided with a pre-press nip and a separate extended nip. A pick-up felt runs through the pre-press nip and the extended nip and the web is transferred on support of the pick-up felt through both nips. The pre-press nip is formed between a pick up roll serving as an upper roll and a hollow-faced counter roll serving as a lower roll, and the extended nip is formed between a shoe roll serving as an upper roll and a smooth-faced counter roll serving as a lower roll. Thus, the web runs in the first nip between the pick-up felt and a press felt, in which connection dewatering of the web takes place in both directions. In the second nip, the web in turn runs between the smooth-faced counter roll and the pick-up felt, in which connection dewatering takes place mainly in one direction. The web is transferred from the smooth-faced counter roll of the second nip as a short open draw onto a drying wire. Two press felts are used in this arrangement.

In U.S. Pat. No. 4,988,410 (Voith), FIGS. 1 and 2 show a press section provided with two separate extended nips. The web is picked up from a forming section by a pick-up roll and passed between a pick-up felt and a first press felt into the first extended nip. Either the pick-up felt or the first press felt also runs through the second extended nip. The first extended nip is thus double-felted, in which connection dewatering of the web takes place in two directions. The second extended nip is in turn single-felted, in which connection dewatering of the web takes place mainly in one direction. The web is transferred from the surface of a counter roll of the second extended nip as a short open draw to a dryer section. The separation of the web from one press felt and its adherence to the opposite press felt between the first and second extended nips takes place here by means of a separate suction box. Two press felts are used in this arrangement.

SUMMARY OF THE INVENTION

The aim of the present invention is to provide a small, efficient, inexpensive and simple press section which can be applied in particular in paper or board machine rebuilds.

The press section according to the invention comprising 2–3 felt loops provides a good water treatment capacity and a good symmetry with respect to roughness and absorption.

The press section according to the invention can be applied to several paper grades. When rebuilding old press sections into ones according to the invention it is possible to use press rolls of the old press section.

The press section according to the invention is most suitable for a speed range below about 1200 m/min.

In a double-felted first press nip applied in the invention, water is removed from the web into both press felts and, by the action of an underpressure in a press suction roll, the web follows after the first press nip the press felt on the side of the press suction roll. In that connection, the press felts can be separated from each other immediately after the first press nip and the web is transferred onwards on the surface of the press felt situated on the side of the press suction roll. In addition, the dewatering in the first press nip is enhanced, i.e. the dry solids content of the web increases by the action of the underpressure of the press suction roll. When the web follows the press felt on the side of the press suction roll immediately after the first press nip, the rewetting caused by the opposite press felt after the press nip is reduced because the web is no longer in contact with the opposite press felt. The rewetting caused by the press felt on the side of the press suction roll is also reduced because the underpressure of the press suction roll keeps the water better in the press felt and when the web expands (in the z-direction), it draws less water. Since the web already chooses the right press felt in the first press nip, a separate transfer suction roll or equivalent is not needed after the first press nip for forcing the web to follow the right press felt.

Furthermore, in the invention, either the first upper press felt or the first lower press felt is passed through both press nips. When a press felt runs through two press nips, a new press felt can be brought more quickly into an optimal operating state. A new press felt is usually bulky and it is compacted by about 30% during a twenty-four hours period of running. The dewatering properties of the press felt are improved when it has become slightly denser, and this compaction occurs more quickly in a situation in which the press felt travels through two press nips when compared with a situation in which the press felt travels only through one press nip. A drawback is, of course, that the press felt wears more quickly when it runs through two press nips.

A roll nip or an extended nip can be used as the first nip. An extended nip provides in itself a higher dry solids content than a roll nip because of a longer nip and a higher linear load.

By using an extended nip as the second press nip, a sufficiently long dwell time can be provided in the last nip, whereby a sufficiently high dry solids content of the web is achieved with a relatively low peak compression pressure.

In the arrangement according to the invention, the web is passed mainly as a closed draw from a forming wire onto a drying wire. An exception to the fully closed draw is constituted by a short free draw used in some embodiments of the invention from the smooth-faced counter roll of the second press nip $N_2$ of the press section to a paper guide roll which is placed after that and on which the web is passed forwards.

BRIEF DESCRIPTION OF THE DRAWINGS

In the following, the invention will be described in detail with reference to the different embodiments of the invention shown in the figures in the accompanying drawing, to the details of which embodiments the invention is, however, not by any means narrowly confined.

DESCRIPTION OF THE PREFERRED EMBODIMENTS

Figure 1:
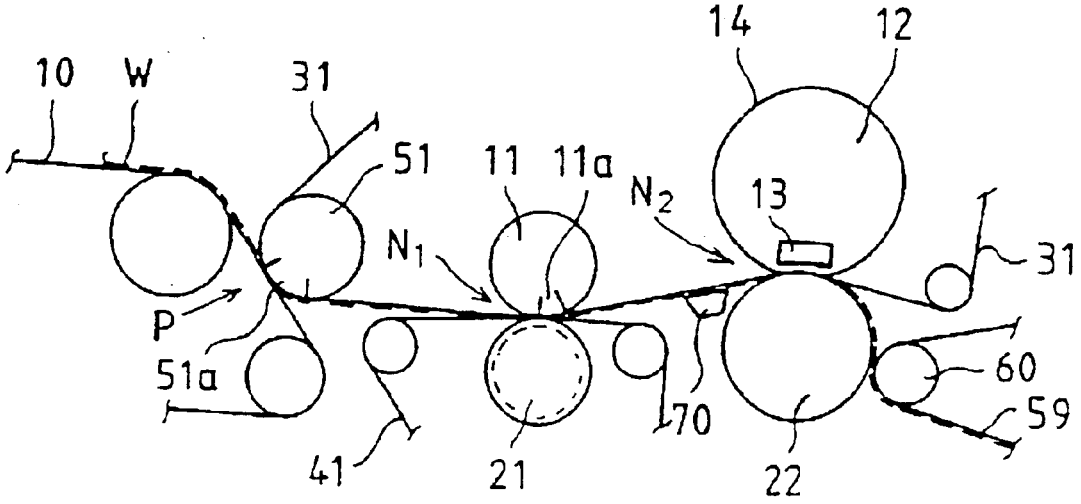
FIG. 1 is a schematic view of one press section according to the invention.

FIG. 1 schematically shows an embodiment of the invention in which the first nip is a double-felted roll nip $N_1$ and the second nip is a single-felted extended nip $N_2$ and in which a pick-up felt 31 runs as an upper felt through both nips $N_1$, $N_2$. A first lower felt 41 runs only through the first nip $N_1$.

In the embodiment shown in FIG. 1, a web W is separated from a forming wire 10 at a pick-up point P and transferred to a suction zone 51*a* of a pick-up roll 51 onto the first upper felt 31. After the pick-up point P, the web W is passed on the lower surface of the first upper felt 31 as a straight run substantially in a horizontal plane into the first nip $N_1$, which is a double-felted roll nip. The upper roll of the first nip $N_1$ is a press suction roll 11 and the lower roll thereof is a hollow-faced press roll 21. After the first nip $N_1$, the first upper felt 31 is immediately separated from the first lower felt 41 and the web W is immediately caused to adhere to the first upper felt 31 in a suction sector 11*a* of the press suction roll 11 functioning as the upper roll in the first nip $N_1$. After that, the web W is passed on the lower surface of the first upper felt 31 as a straight run obliquely upwards into the second nip $N_2$, which is a single-felted extended nip. The upper roll of the second nip $N_2$ is a shoe roll 12, which is formed of a flexible hose shell 14 with a press shoe 13 loadable with a hydraulic pressure medium placed inside it to produce the necessary compression pressure in the web W running between the first upper felt 31 and a smooth-faced counter roll 22. After the second nip $N_2$, the web W is passed a short distance on the outer surface of the counter roll 22 serving as the lower roll of the second nip $N_2$, after which the web W is transferred as a short open draw onto a drying wire 59 guided by a guide roll 60 and on it further to a dryer section (not shown in the figure). At low speeds, the guide roll 60 can be against the counter roll 22, in which connection the web W has no open draw at all. Said open draw is very short in any case, being normally of the order of about 10 mm. Between the first $N_1$ and the second $N_2$ nip, underneath the web W there is additionally a steam box 70, by which it is possible to regulate the dry solids content of the web W and the cross-direction profile of the dry solids content of the web W.

Figure 2:
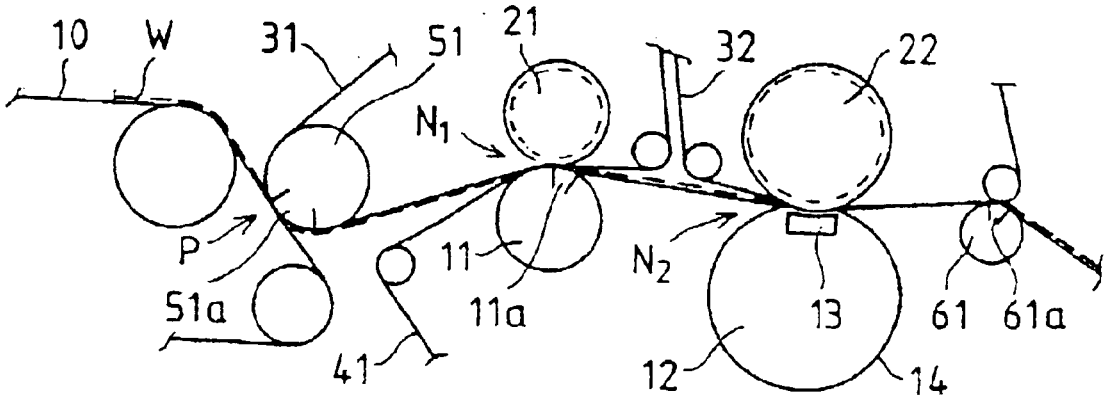
FIG. 2 is a schematic view of another press section according to the invention.

FIG. 2 schematically shows another embodiment of the invention in which the first nip is a double-felted roll nip $N_1$ and the second nip is a double-felted extended nip $N_2$ and in which a lower press felt 41 runs through both nips $N_1$, $N_2$. A first upper felt 31 runs here only through the first nip $N_1$ and a second upper felt 32 runs only through the second nip $N_2$.

In the embodiment shown in FIG. 2, the web W is separated from a forming wire 10 at a pick-up point P and transferred to a suction zone 51*a* of a pick-up roll 51 onto the first upper felt 31. After the pick-up point P, the web W is passed on the lower surface of the first upper felt 31 as a straight run obliquely upwards into the first nip $N_1$, which is a double-felted roll nip. The upper roll of the first nip $N_1$ is a hollow-faced press roll 21 and the lower roll thereof is a press suction roll 11. After the first nip $N_1$, the first upper felt 31 is immediately separated from the first lower felt 41 and the web W is immediately caused to adhere to the first lower felt 41 in a suction sector 11*a* of the press suction roll 11 functioning as the lower roll in the first nip $N_1$. After that, the web W is passed on the upper surface of the first lower felt 41 as a straight run obliquely downwards into the second nip $N_2$, which is a double-felted extended nip. The lower roll of the second nip $N_2$ is a shoe roll 12, which is formed of a flexible hose shell 14 with a press shoe 13 loadable with a hydraulic pressure medium placed inside it to produce the necessary compression pressure in the web W running between the second upper felt 32 and the first lower felt 41. After the second nip $N_2$, the web W is passed between the second upper felt 32 and the first lower felt 41 as a straight run obliquely upwards onto a first transfer suction roll 61 situated inside the loop of the first lower felt 41. In a suction sector 61*a* of the first transfer suction roll 61, the second upper felt 32 is separated from the first lower felt 41 and the web W is caused to adhere to the first lower felt 41, from which the web W is passed to a dryer section (not shown in the figure).

Figure 3:
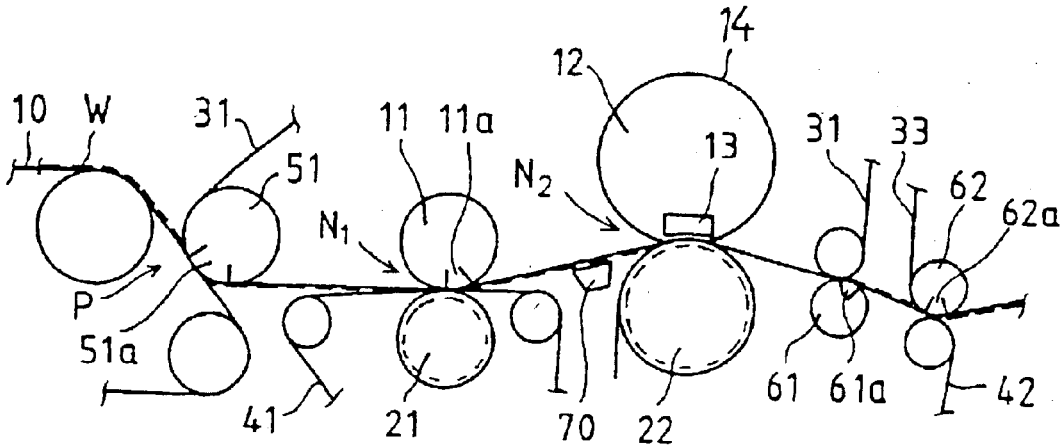
FIG. 3 is a schematic view of a variant of the embodiment shown in FIG. 1.

FIG. 3 shows a variant of the embodiment shown in FIG. 1, in which the second nip $N_2$ is also double-felted. A second lower felt 42 is passed through the second nip $N_2$, in which connection the lower roll 22 of the second nip $N_2$ is hollow-faced. After the second nip $N_2$, the web W is passed between the first upper felt 31 and the second lower felt 42 as a straight run obliquely downwards to a first transfer suction roll 61 situated inside the loop of the second lower felt 42. In a suction sector 61*a* of the first transfer suction roll 61, the first upper felt 31 is separated from the second lower felt 42 and the web W is caused to adhere to the second lower felt 42, on the upper surface of which the web W is passed as a straight run obliquely downwards to a second transfer suction roll 62. In a suction sector 62*a* of the second transfer suction roll 62, the web is separated from the second lower felt 42 and caused to adhere to a first transfer upper wire 33, from which the web W is transferred to a dryer section (not shown in the figure).

Figure 4:
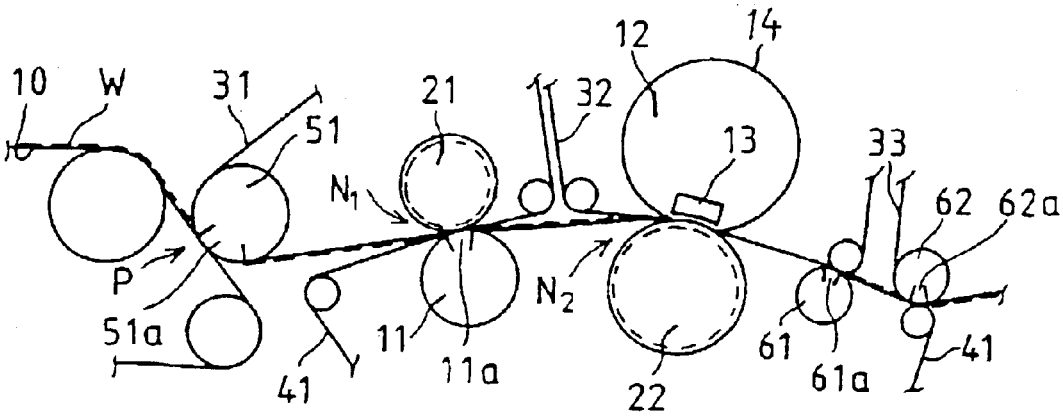
FIG. 4 is a schematic view of a variant of the embodiment shown in FIG. 2.

FIG. 4 shows a variant of the embodiment shown in FIG. 2. The positions of the shoe roll 12 and the counter roll 22 are inverted such that the shoe roll 12 is an upper roll and the hollow-faced counter roll 22 is a lower roll. In addition, the run of the web W between the first $N_1$ and the second $N_2$ nip is obliquely upwards. After the second nip $N_2$, the web W runs obliquely downwards to the first transfer suction roll 61. After the first transfer suction roll 61, the web is passed on the upper surface of the first lower felt 41 to a second transfer suction roll 62. In a suction sector 62*a* of the second transfer suction roll 62, the web is separated from the first lower felt 41 and caused to adhere to a first transfer upper wire 33, from which the web W is transferred to a dryer section (not shown in the figure).

Figure 5:
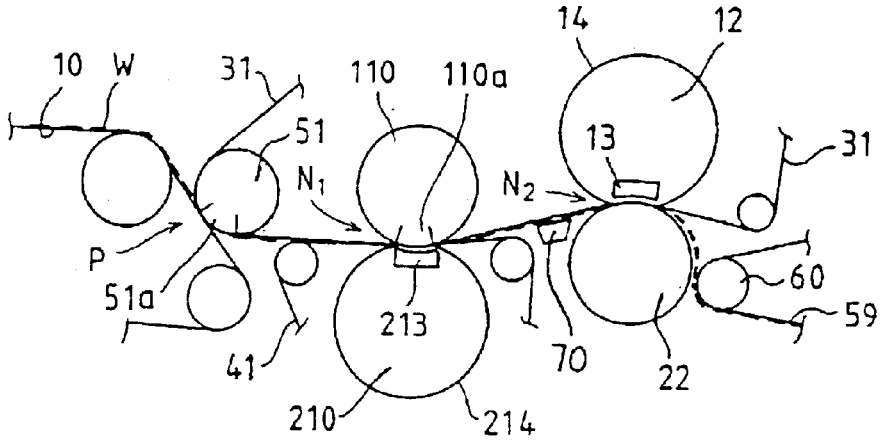
FIG. 5 is a schematic view of a variant of the embodiment shown in FIG. 1.

FIG. 5 shows a variant of the embodiment shown in FIG. 1. In this embodiment, the first nip $N_1$ is also an extended nip. The upper roll in the first nip $N_1$ is a press suction roll 110 and the lower roll thereof is a shoe roll 210. The shoe roll 210 is formed of a flexible hose shell 214 with a press shoe 213 loadable with a hydraulic pressure medium placed inside it to produce the necessary compression pressure in the web W running between the first upper felt 31 and the first lower felt 41. In other respects, the embodiment shown in FIG. 5 corresponds to the embodiment shown in FIG. 1.

Figure 6:
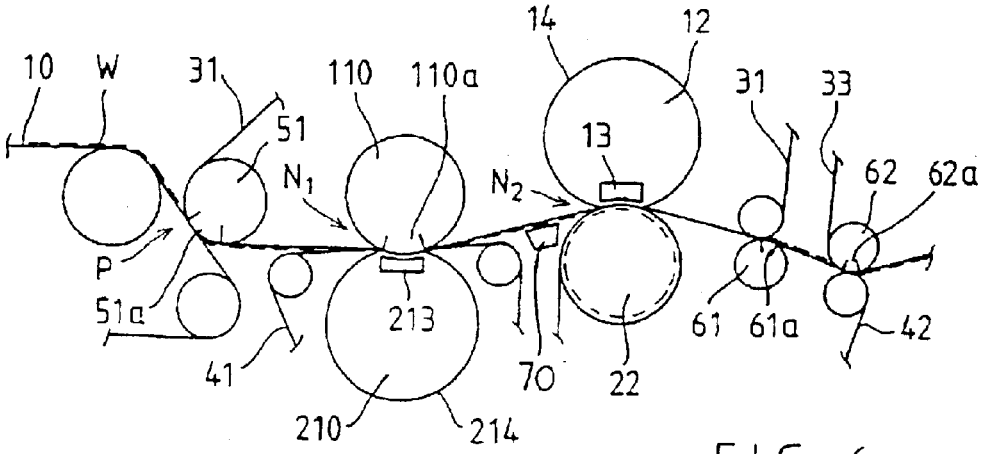
FIG. 6 is a schematic view of a variant of the embodiment shown in FIG. 3.

FIG. 6 shows a variant of the embodiment shown in FIG. 3. In this embodiment, the first nip $N_1$ is an extended nip. The structure of the first nip $N_1$ corresponds to the structure of the first nip $N_1$ of the embodiment shown in FIG. 5. In other respects, the embodiment shown in FIG. 6 corresponds to the embodiment shown in FIG. 3.

Figure 7:
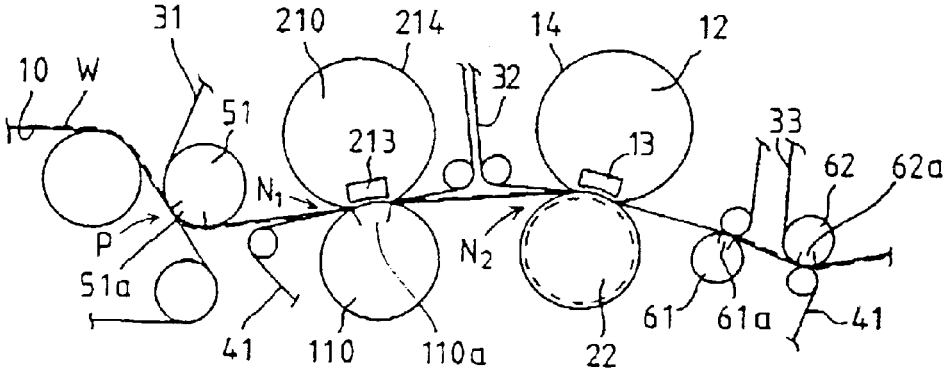
FIG. 7 is a schematic view of a variant of the embodiment shown in FIG. 4.

FIG. 7 shows a variant of the embodiment shown in FIG. 4. In this embodiment, the first nip $N_1$ is an extended nip. The structure of the first nip $N_1$ corresponds to the structure of the first nip $N_1$ of the embodiment shown in FIG. 5 with the difference that the shoe roll 210 is the upper roll of the nip $N_1$ and the press suction roll 110 is the lower roll thereof. In other respects, the embodiment shown in FIG. 7 corresponds to the embodiment shown in FIG. 4.

Figure 8:
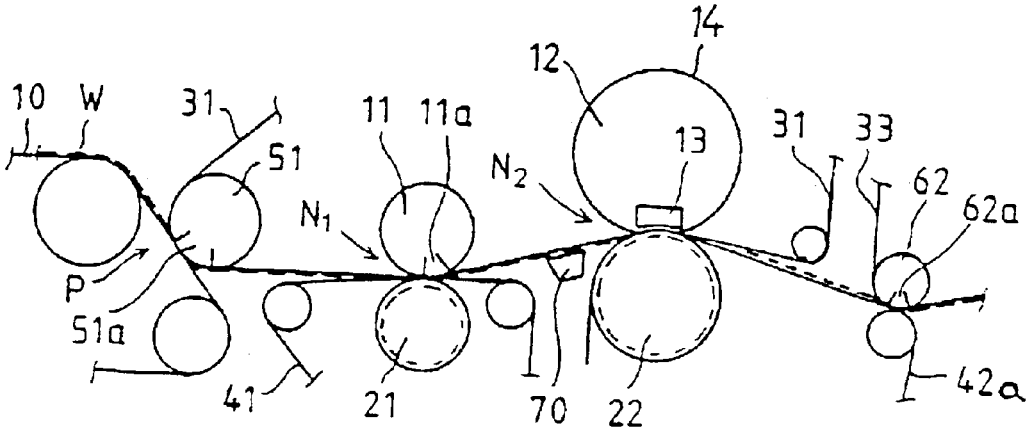
FIG. 8 is a schematic view of another variant of the embodiment shown in FIG. 3.

FIG. 8 shows another variant of the embodiment shown in FIG. 3. In this embodiment, a substantially water-non-receiving transfer belt 42*a* is used as the lower fabric in the second nip $N_2$ of the press section. The upper felt 31 and the transfer belt 42*a* are separated from each other immediately after the second nip $N_2$. In that connection, the web W follows immediately after the second nip $N_2$ the smooth-faced transfer belt 42*a*, the capability of which to adhere to the web W is considerably greater than the adhesion capability of the upper felt 31 serving as the upper fabric of the second nip $N_2$. In that connection, there is no need for the first transfer suction roll 61 shown in FIG. 3, by which roll the web W is separated from the upper felt 31 and caused to adhere to the second lower felt 42 before the web W is transferred to a dryer section.

Figure 9:
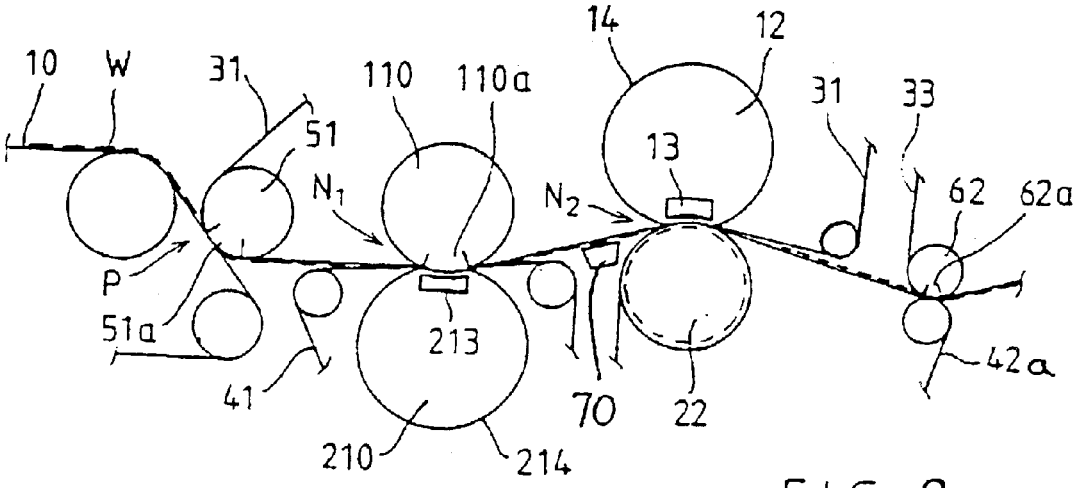
FIG. 9 is a schematic view of a variant of the embodiment shown in FIG. 6.

FIG. 9 shows a variant of the embodiment shown in FIG. 6. This embodiment corresponds to the embodiment shown in FIG. 8 with respect to the second nip $N_2$ and the portion after that. Thus, the lower fabric of the second nip $N_2$ is a substantially water-non-receiving transfer belt 42*a*.

In the embodiments shown in FIGS. 2–4 and 6–7, both nips $N_1$, $N_2$ are double-felted, in which connection water is transferred in the nips $N_1$, $N_2$ into both felts substantially symmetrically so as to provide a web which is symmetric enough in the z-direction and both sides of which are identical. This kind of paper is particularly suitable for writing or printing paper. By the underpressure prevailing in the suction zone 11*a*, 110*a* of the press suction rolls 11, 110 in the first nip $N_1$ it is assured that the web W follows after the first nip $N_1$ the felt 31, 41 on the side of the press suction roll 11, 110, in which connection the opposite felt 41, 31 can be separated from the felt 31, 41 on the side of the press suction roll 11, 110 immediately after the nip zone, which substantially prevents the rewetting of the web.

In the embodiments shown in FIGS. 8 and 9, the first nip $N_1$ is double-felted and in the second nip $N_2$ there are two fabrics. Since the lower fabric in the second nip $N_2$ is a substantially water-non-receiving transfer belt 42*a*, in the second nip $N_2$ water is removed from the web W only into the upper felt 31.

In the embodiments shown in FIGS. 5–7 and 9, in which the first nip $N_1$ is an extended nip, the extent of the suction zone 110*a* of the press suction roll 110 is generally only about 8° to 16°, most preferably about 10° to 14° extending only to the area of the extended-nip zone or zones or only slightly over it. Since the press suction roll 110 is used in the extended-nip zone, said roll 110 must be dimensioned so as to be sturdier than a normal suction roll to withstand the high linear loads of the extended nip. For this purpose, the diameter of the press suction roll 110 is usually chosen from a range of about 800 to 2000 mm. Also, the thickness and the perforations of the perforated shell of the press suction roll 110 are dimensioned in view of high nip loads. To this end, the thickness of the shell of the suction roll 110 is usually chosen from a range of about 50 to 120 mm. The proportion of the open area in the shell of the suction roll 110, i.e. the hole percentage, is usually chosen from a range of about 10 to 40%. The strength of the shell of the suction roll 110 can also be increased by the selection of its material. The underpressure prevailing in the suction zone 110*a* of the press suction roll 110 is usually chosen from a range of about 20 to 70 kPa depending on the application.

In the embodiments shown in FIGS. 1–4 and 8, the bulk of the water in the web W is removed in the last nip $N_2$, which is an extended nip. In the first nip $N_1$, which is a roll nip, only the water which is easily removable from the web W is removed from it.

In the embodiments shown in FIGS. 1, 3, 5, 6, 8 and 9, a blow suction box (not shown in the figures) is additionally needed at high speeds (about more than 1000 m/min) between the first nip $N_1$ and the second nip $N_2$ on the upper side of the first upper felt 31, which blow box assures that the web W adheres to the lower surface of the first upper felt 31 between the first $N_1$ and second $N_2$ nips.

In the embodiment shown in FIG. 1, the press section can also be run such that the first nip $N_1$ is open, in which connection the press suction roll 21 provided as the lower roll of the first nip $N_1$ is lowered. In that connection, there is only one nip in use in the press section, which nip is the extended nip $N_2$. The web will then become unequal-sided with respect to roughness and absorption. The paper manufactured in this manner is, however, very suitable, for example, for label paper, one side of which is smooth and the other side of which is rough. When the speed is less than about 1000 m/min, the extended nip $N_2$ alone provides substantially the same dry solids content for woodfree porous web grades as that achieved in a situation in which the first roll nip $N_1$ is also in operation. This is accounted for by the fact that water is removed from the porous web W in the first roll nip $N_1$ to be sure but, at the same time, the porous web W becomes denser, as a result of which the water removal channels in the web W are closed, thereby making it more difficult to remove water in the second extended nip $N_2$.

As is clear from the accompanying figures, an essential feature in several embodiments of the invention is also that the run of the web through the entire press section is very straight so that in the run of the web there are no large curves which might subject the web to so high dynamic forces that the web becomes separated from the surface supporting it, such as from a press felt. The largest angle of the change of course of the web W is less than about 45°, most preferably less than about 30°.

The claims are presented in the following and the various details of the invention may vary within the inventive idea defined by said claims and differ from those given above by way of example only.

What is claimed is:

1. A pressing section in a papermaking machine comprising:

a first press nip formed between a press suction roll and a pressing member;

a first water-receiving press felt engaged with the press suction roll, and passing through the first press nip;

a second water-receiving press felt engaged with the pressing member and passing through the first press nip, wherein the first press felt separates from the second press felt after leaving the first press nip;

a web passing through the first press nip between the first press felt and the second press felt, and following the first press felt when the first press felt separates from the second press felt;

a means for creating an under pressure in a suction zone of said press suction roll to cause the web to follow the first press felt where the first press felt separates from the second press felt; and a second press nip formed between a second press roll and a second pressing member, wherein the first press felt and the web pass through the second press nip; wherein the first press nip and the second press nip are separate; and wherein the first press nip of the press section is an extended nip in which the pressing member is a shoe roll provided with a hose shell and a press shoe system.

2. The press section of claim 1 wherein the second press nip is an extended nip, in which the second press member is a shoe roll having a hose shell and a press shoe system and the second press roll is a smooth- or hollow-faced counter roll.

3. The press section of claim 1 wherein the first water-receiving press felt is an upper pick-up felt on which the web is passed from a pick-up point of a forming wire into the first press nip of the press section and further into the second press nip of the press section, and the second water-receiving press felt is a lower press felt which runs only through the first press nip.

4. The press section of claim 3 further comprising a third press felt which runs only through the second press nip and is positioned beneath the first water-receiving press felt.

5. The press section of claim 3 further comprising a substantially water-non-receiving transfer belt which runs only through the second press nip and is positioned beneath the first water-receiving press felt.

6. The press section of claim 1 wherein the second water-receiving press felt is an upper pick-up felt on which the web is passed from a pick-up point of a forming wire into the first press nip of the press section and the first water-receiving press felt is a lower press felt which runs through both press nips and on support of which the web is passed after the first press nip of the press section into the second press nip of the press section.

7. The press section of claim 6 further comprising a third press felt which runs only through the second press nip and is positioned above the first water-receiving press felt.

* * * * *